US011466677B2

(12) United States Patent
Hattori et al.

(10) Patent No.: US 11,466,677 B2
(45) Date of Patent: Oct. 11, 2022

(54) CONTROL DEVICE FOR ELECTRIC COMPRESSOR, ELECTRIC COMPRESSOR, AIR CONDITIONING DEVICE FOR MOVING OBJECT, AND METHOD FOR CONTROLLING ELECTRIC COMPRESSOR

(71) Applicant: MITSUBISHI HEAVY INDUSTRIES THERMAL SYSTEMS, LTD., Tokyo (JP)

(72) Inventors: Makoto Hattori, Tokyo (JP); Toyohisa Kawashima, Tokyo (JP); Takayuki Takashige, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 236 days.

(21) Appl. No.: 16/634,862

(22) PCT Filed: Aug. 15, 2018

(86) PCT No.: PCT/JP2018/030339

§ 371 (c)(1),
(2) Date: Jan. 28, 2020

(87) PCT Pub. No.: WO2019/049620

PCT Pub. Date: Mar. 14, 2019

(65) Prior Publication Data

US 2020/0232453 A1 Jul. 23, 2020

(30) Foreign Application Priority Data

Sep. 7, 2017 (JP) ..... JP2017-171975

(51) Int. Cl.
*F04B 49/06* (2006.01)
*F04B 35/04* (2006.01)
(Continued)

(52) U.S. Cl.
CPC ..... *F04B 49/06* (2013.01); *F04B 35/04* (2013.01); *F04B 49/02* (2013.01); *F04B 49/10* (2013.01);
(Continued)

(58) Field of Classification Search
CPC ..... F04B 49/06; F04B 35/04; F04B 49/02; F04B 49/10; F04B 49/20; F04B 2203/0201; F04B 2203/0209; F25B 2600/021
See application file for complete search history.

(56) References Cited

U.S. PATENT DOCUMENTS

2010/0106363 A1 4/2010 Mandujano
2010/0235046 A1 9/2010 Proefke
(Continued)

FOREIGN PATENT DOCUMENTS

CN 204956360 U 1/2016
CN 105444328 A 3/2016
(Continued)

OTHER PUBLICATIONS

International Search Report for International Application No. PCT/JP2018/030339, dated Nov. 13, 2018, with English translation.
(Continued)

*Primary Examiner* — Patrick Hamo
(74) *Attorney, Agent, or Firm* — Birch, Stewart, Kolasch & Birch, LLP

(57) ABSTRACT

A control device for a compressor includes an operation stop control unit that stops the compressor in a procedure different from a normal stop request signal when a signal different from the normal stop request signal that requests the compressor to stop in a predetermined procedure and a forced stop request signal from a device including the compressor is detected. The operation stop control unit stops the com-
(Continued)

(a)

| PRE-STOP SPEED | STANDBY SPEED | DECELERATION RATE | STANDBY TIME |
|---|---|---|---|
| SPEED REGION 1: PRE-STOP SPEED ≥ THRESHOLD VALUE 1 | PRE-STOP SPEED - A | α | T1 (INCLUDING 0) |
| SPEED REGION 2: THRESHOLD VALUE 1 > PRE-STOP SPEED ≥ THRESHOLD VALUE 2 | B | β | T2 (INCLUDING 0) |
| SPEED REGION 3: THRESHOLD VALUE 2 > PRE-STOP SPEED | 0 | γ | 0 |

(b)

pressor in the different procedure according to a speed of the compressor when the forced stop request signal is detected.

16 Claims, 6 Drawing Sheets

(51) Int. Cl.
*F04B 49/02* (2006.01)
*F04B 49/10* (2006.01)
*F04B 49/20* (2006.01)

(52) U.S. Cl.
CPC ..... *F04B 49/20* (2013.01); *F04B 2203/0201* (2013.01); *F04B 2203/0209* (2013.01); *F25B 2600/021* (2013.01)

(56) References Cited

U.S. PATENT DOCUMENTS

| | | | |
|---|---|---|---|
| 2016/0368345 | A1 | 12/2016 | Farooq et al. |
| 2018/0022184 | A1 | 1/2018 | Ohyama et al. |

FOREIGN PATENT DOCUMENTS

| | | | |
|---|---|---|---|
| CN | 106224221 | A | 12/2016 |
| CN | 106500241 | A | 3/2017 |
| DE | 102016 110881 | A1 | 12/2016 |
| DE | 10 2010 009 320 | B4 | 4/2017 |
| JP | 58-99635 | A | 6/1983 |
| JP | 61-38344 | A | 2/1986 |
| JP | 62-4618 | B2 | 1/1987 |
| JP | 11-211194 | A | 8/1999 |
| JP | 2009-52797 | A | 3/2009 |
| JP | 2012-196063 | A | 10/2012 |
| WO | WO 2016/136382 | A1 | 9/2016 |

OTHER PUBLICATIONS

Written Opinion of the International Searching Authority for International Application No. PCT/JP2018/030339, dated Nov. 13, 2018, with English translation.

(a)

| PRE-STOP SPEED | STANDBY SPEED | DECELERATION RATE | STANDBY TIME |
|---|---|---|---|
| SPEED REGION 1: PRE-STOP SPEED ≥ THRESHOLD VALUE 1 | PRE-STOP SPEED − A | α | T1 (INCLUDING 0) |
| SPEED REGION 2: THRESHOLD VALUE 1 > PRE-STOP SPEED ≥ THRESHOLD VALUE 2 | B | β | T2 (INCLUDING 0) |
| SPEED REGION 3: THRESHOLD VALUE 2 > PRE-STOP SPEED | 0 | γ | 0 |

(b)

| PRE-STOP SPEED | STANDBY SPEED | DECELERATION RATE | STANDBY TIME |
|---|---|---|---|
| SPEED REGION 1: PRE-STOP SPEED ≥ THRESHOLD VALUE 1 | PRE-STOP SPEED - A1 | α1 | 0 |
| SPEED REGION 2: THRESHOLD VALUE 1 > PRE-STOP SPEED ≥ THRESHOLD VALUE 2 | B1 | α1 | T3 |
| SPEED REGION 3: THRESHOLD VALUE 2 > PRE-STOP SPEED | 0 | NONE | 0 |

CONTROL DEVICE FOR ELECTRIC COMPRESSOR, ELECTRIC COMPRESSOR, AIR CONDITIONING DEVICE FOR MOVING OBJECT, AND METHOD FOR CONTROLLING ELECTRIC COMPRESSOR

TECHNICAL FIELD

The present invention relates to a control device for an electric compressor, an electric compressor, an air conditioning device for a moving object, and a method for controlling an electric compressor. Priority is claimed on Japanese Patent Application No. 2017-171975, filed on Sep. 7, 2017, the content of which is incorporated herein by reference.

BACKGROUND ART

One of constituent elements of a car air conditioner mounted on a vehicle is an electric compressor. In a case where a user performs an operation to stop the car air conditioner, an electric compressor and a motor that drives the electric compressor are stopped through a predetermined process incorporated in an operation stop control of the car air conditioner. For example, a process to stop the motor is executed by receiving a command for stepwise setting a speed to zero. As a related art, PTL 1 discloses a motor control device that positions a rotor and then performs a stop operation.

CITATION LIST

Patent Literature

[PTL 1] Japanese Unexamined Patent Application Publication No. 2012-196063

SUMMARY OF INVENTION

Technical Problem

However, the electric compressor of the car air conditioner does not always stop through the process as described above. For example, in a case where the user performs an operation to stop the vehicle (turns off key) while the car air conditioner is in operation, the car air conditioner needs to suddenly stop the electric compressor before the power supply is stopped due to the key off and the electric compressor is suddenly stopped. In the case, the operation of the electric compressor may be stopped without going through the process as described above. An abnormal current may flow through a control circuit of the electric compressor and affect electronic components or the like depending on a condition such as an operation environment and operation state of the electric compressor when the key is turned off.

The invention provides a control device for an electric compressor, an electric compressor, an air conditioning device for a moving object, and a method for controlling an electric compressor capable of solving the above problems.

Solution to Problem

According to an aspect of the invention, a control device for an electric compressor includes a stop request detector that detects a forced stop request signal for requesting a forced stop with respect to an electric compressor, and an operation stop control unit that stops the electric compressor in a process different from a normal stop process determined for the electric compressor when the stop request detector detects the forced stop request signal. The operation stop control unit stops the electric compressor in the different process according to a speed of the electric compressor when the forced stop request signal is detected.

According to an aspect of the invention, the operation stop control unit of the control device determines a speed range where the speed when the forced stop request signal is detected is included among a plurality of speed ranges determined stepwise for the speed of the electric compressor and stops the electric compressor based on a process determined for each speed range.

According to an aspect of the invention, the operation stop control unit of the control device decelerates the speed when the forced stop request signal is detected based on a deceleration rate determined for the speed when the forced stop request signal is detected.

According to an aspect of the invention, the operation stop control unit of the control device decelerates the speed of the electric compressor by a predetermined speed based on the deceleration rate.

According to an aspect of the invention, the operation stop control unit of the control device decelerates the speed of the electric compressor to a predetermined speed based on the deceleration rate.

According to an aspect of the invention, the operation stop control unit of the control device decelerates the speed of the electric compressor based on the deceleration rate, then stands by for a predetermined time, and then stops the electric compressor.

According to an aspect of the invention, in a case where the speed when the forced stop request signal is detected is equal to or larger than a first threshold value, the operation stop control unit of the control device decelerates the speed of the electric compressor by a predetermined speed at a deceleration rate determined for a speed range equal to or larger than the first threshold value and then stops a rotation of the electric compressor.

According to an aspect of the invention, in a case where the speed when the forced stop request signal is detected is equal to or larger than a second threshold value and less than the first threshold value, the operation stop control unit of the control device decelerates the speed of the compressor to a predetermined speed at a deceleration rate determined for a speed range of from the second threshold value to the first threshold value, then stands by for a predetermined time, and then stops the rotation of the electric compressor.

According to an aspect of the invention, in a case where the speed when the forced stop request signal is detected is less than the second threshold value, the operation stop control unit of the control device immediately stops the rotation of the electric compressor.

According to an aspect of the invention, an electric compressor includes the control device for an electric compressor according to any one of the above.

According to an aspect of the invention, an air conditioning device for a moving object includes the above electric compressor.

According to an aspect of the invention, a method for controlling an electric compressor includes a step of detecting a forced stop request signal for requesting a forced stop with respect to an electric compressor, and a step of stopping the electric compressor in a process different from a normal stop process determined for the electric compressor when the forced stop request signal is detected. The electric compressor is stopped in the different process according to a speed of the electric compressor when the forced stop request signal is detected in the step of stopping the electric compressor.

Advantageous Effects of Invention

With the control device for the electric compressor, the electric compressor, the air conditioning device for the moving object, and the method for controlling the electric compressor, it is possible to safely stop the electric compressor even in the case where the forced stop request different from the normal stop request signal is received.

DESCRIPTION OF EMBODIMENTS

Embodiment

Figure 1:
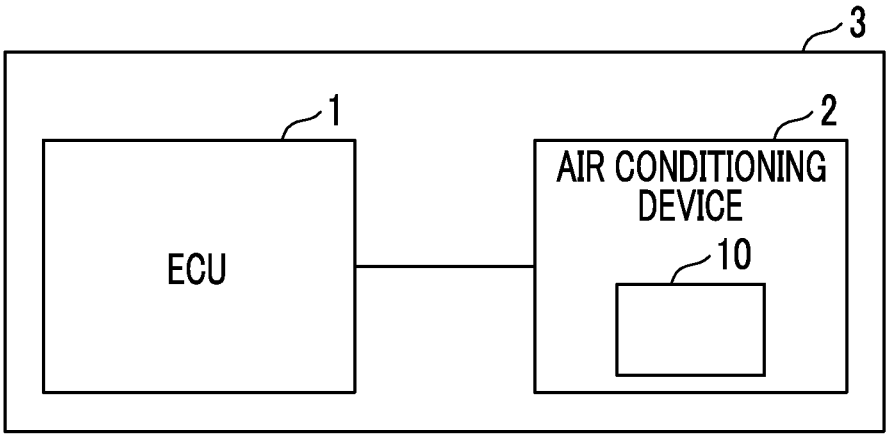
FIG. 1 is a schematic block diagram of a vehicle on which an electric compressor is mounted according to an embodiment of the invention.

Hereinafter, a method for controlling an electric compressor according to an embodiment of the invention will be described with reference to FIGS. 1 to 7. FIG. 1 is a schematic block diagram of a vehicle on which the electric compressor is mounted according to the embodiment of the invention. FIG. 1 shows an electric control unit (ECU) 1 and an in-vehicle air conditioning device 2 which are mounted on a vehicle 3. As shown in FIG. 1, the vehicle 3 includes the ECU 1 and the air conditioning device 2. The air conditioning device 2 includes an electric compressor 10. The ECU 1 controls electric apparatuses of the vehicle 3. The air conditioning device 2 is a car air conditioner unit. The electric compressor 10 is an electric compressor used in an in-vehicle air conditioning device. The electric compressor 10 is an inverter-integrated electric compressor in which an inverter device is incorporated integrally. The ECU 1 and the air conditioning device 2 are connected by a signal line, a communication line, a power line, and the like, and the air conditioning device 2 receives a control signal of the ECU 1 by controller area network (CAN) communication to perform a user-desired operation. For example, when the user performs an operation for starting the operation of the air conditioning device, the ECU 1 outputs a control signal corresponding to the operation to the air conditioning device 2 and the air conditioning device 2 starts the operation based on the control signal. When the user sets an in-vehicle temperature, the ECU 1 generates a control signal corresponding to the set temperature to control an operation state of the air conditioning device 2. For example, in a case where the user performs an operation to stop the operation of the air conditioning device, the ECU 1 outputs a control signal for stopping the operation of the air conditioning device 2 in a predetermined procedure (for example, a signal for commanding a speed to stepwise become zero) and the operation of the air conditioning device 2 is stopped according to the control signal. In the case, the operation of the electric compressor 10 incorporated in the air conditioning device 2 is also stopped through a predetermined stop process. However, when the user performs an operation of turning off a key of the vehicle 3 while the operation of the air conditioner is activated, the ECU 1 outputs a stop instruction signal (for example, a power supply shutdown signal) and, for example, one of the signal lines between the ECU 1 and the air conditioning device 2 is in turned-off state. In the case, the operation of the air conditioning device 2 is generally stopped immediately (without going through a predetermined stop process).

Figure 2:
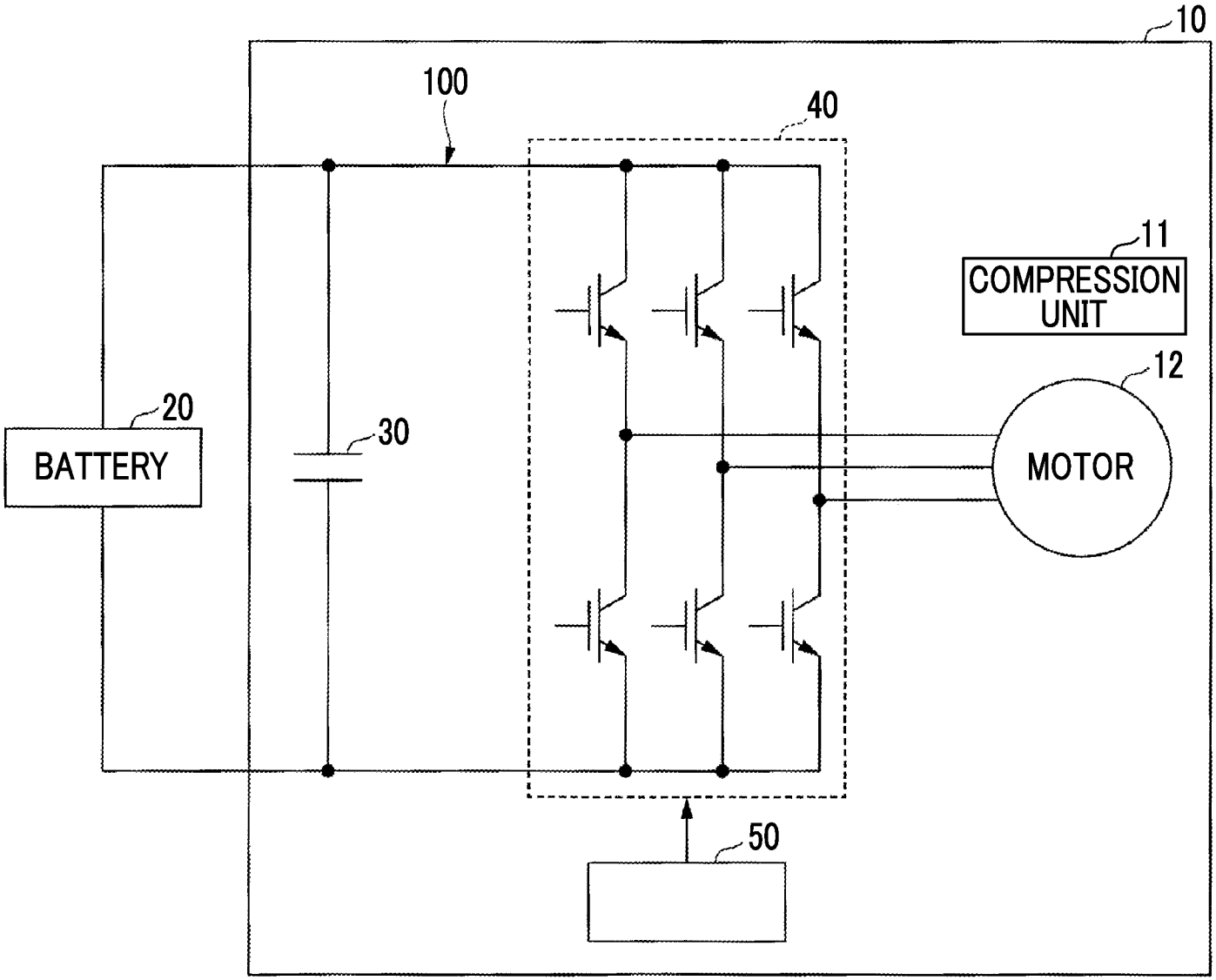
FIG. 2 is a diagram showing an example of the electric compressor in the embodiment of the invention.

FIG. 2 is a diagram showing an example of the electric compressor according to the embodiment of the invention. FIG. 2 shows a schematic configuration of the electric compressor 10 included in the air conditioning device 2. A battery 20 is a power supply unit mounted on the vehicle 3 (outside the air conditioning device 2). The battery 20 supplies high-voltage DC power to the electric compressor 10. The electric compressor 10 includes a circuit 100, a compression unit 11, a motor 12, and a control device 50. The circuit 100 includes a capacitor 30 and an inverter 40. The inverter 40 and the motor 12 are connected by power lines. Predetermined constituent elements included in the circuit 100 and the control device 50 are connected by a signal line. The inverter 40 converts the DC power supplied from the battery 20 into a three-phase AC power and supplies the AC power to the motor 12. As described above, the electric compressor 10 is driven by converting the high-voltage DC power supplied from the power supply unit (battery 20) mounted on the vehicle 3 into the three-phase AC power by the inverter 40 and applying the AC power to the motor 12. The inverter 40 is controlled by the control device 50. The control device 50 is composed of, for example, an integrated circuit (IC) or the like. Power from a low-voltage power supply (not shown) is supplied to the control device 50 separately from the battery 20. For example, the control device 50 controls a speed $\omega$ of the motor 12. The motor 12 is rotationally driven by an instruction from the inverter 40 to cause the compression unit 11 to compress a refrigerant and supply the refrigerant to a refrigerant circuit (not shown) included in the air conditioning device 2.

By the way, when the high-voltage power is supplied to the motor 12 and the power supply is shut down due to the key-off described above while the motor 12 is rotating, a spike current may flow through the circuit 100 (high voltage circuit) illustrated in FIG. 2 and electronic components of the circuit 100 may be affected. Therefore, the control device 50 performs control to stop the motor 12 (the electric compressor 10) while suppressing the occurrence of the abnormal current in a case where the power supply is shut down due to the key-off. Next, the control device 50 will be described.

Figure 3:
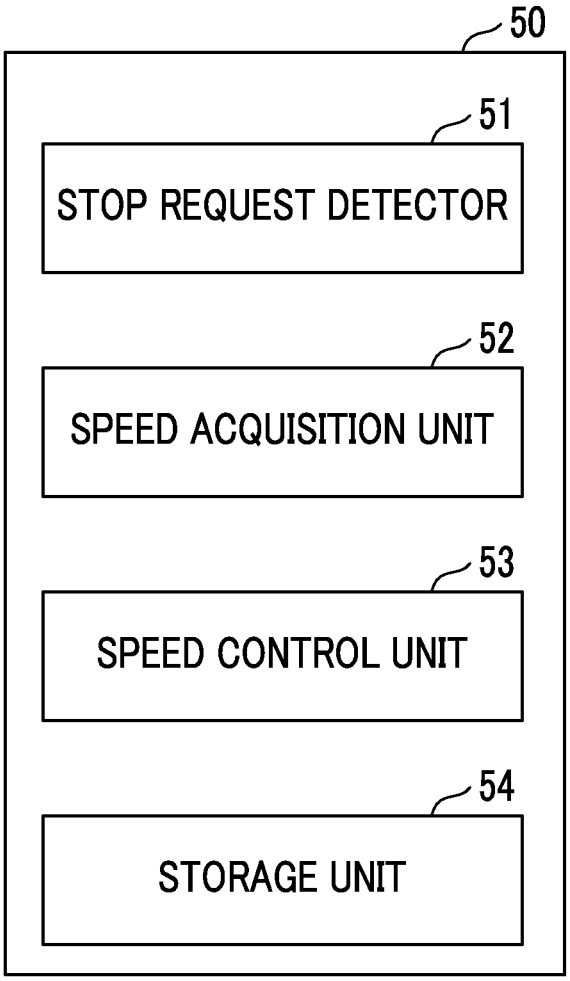
FIG. 3 is a functional block diagram showing an example of a control device according to the embodiment of the invention.

FIG. 3 is a functional block diagram showing an example of a control device according to the embodiment of the invention. As shown in FIG. 3, the control device 50 stores a stop request detector 51, a speed acquisition unit 52, a speed control unit 53, and a storage unit 54. The stop request detector 51 detects a forced stop request signal from a device, facility, system, or the like that includes the electric compressor 10 as a part thereof and a device or the like (for example, vehicle 3) having a function of forcibly stopping the electric compressor 10 regardless of an operation state of the electric compressor 10. The forced stop request signal is a signal different from a normal stop request signal that requests the electric compressor 10 to stop in a predetermined procedure. The normal stop request signal is, for example, a stop instruction signal that the air conditioning device 2 acquires from the ECU 1 when the user performs an operation to turn off the operation of the car air conditioner. The forced stop request signal is, for example, defined as the power supply shutdown signal that the air conditioning device 2 acquires from the ECU 1 at the time of key-off by the user. The stop request detector 51 acquires the normal stop request signal and the forced stop request signal received from the ECU 1 by the air conditioning device 2 through the signal lines or the like.

The speed acquisition unit 52 acquires a speed (speed per unit time) of the electric compressor 10 (motor 12) when the stop request detector 51 detects the forced stop request signal. Hereinafter, the speed when the forced stop request signal is detected is described as a pre-stop speed. When the stop request detector 51 detects the forced stop request signal, the speed control unit 53 performs a process different from the case where the normal stop request signal is acquired to stop the electric compressor 10 (motor 12). For example, the speed control unit 53 determines a speed region where the pre-stop speed is included among a plurality of speed regions obtained by dividing the entire speed range where the electric compressor 10 can have, and stops the electric compressor 10 by a process method determined for the speed region where the pre-stop speed is included. For example, the speed control unit 53 decelerates the speed of the electric compressor 10 at a deceleration rate set according to the pre-stop speed. The speed control unit 53 decelerates the speed at a predetermined deceleration rate, then waits for a standby time set according to the pre-stop speed, and then stops the electric compressor 10. The storage unit 54 stores parameters used by the speed control unit 53 for a forced stop control of the electric compressor 10 (motor 12). The forced stop control is a control for stopping the electric compressor 10 executed by the control device 50 when the user performs the key-off operation (when the stop request detector 51 acquires the forced stop request signal).

Figure 4:
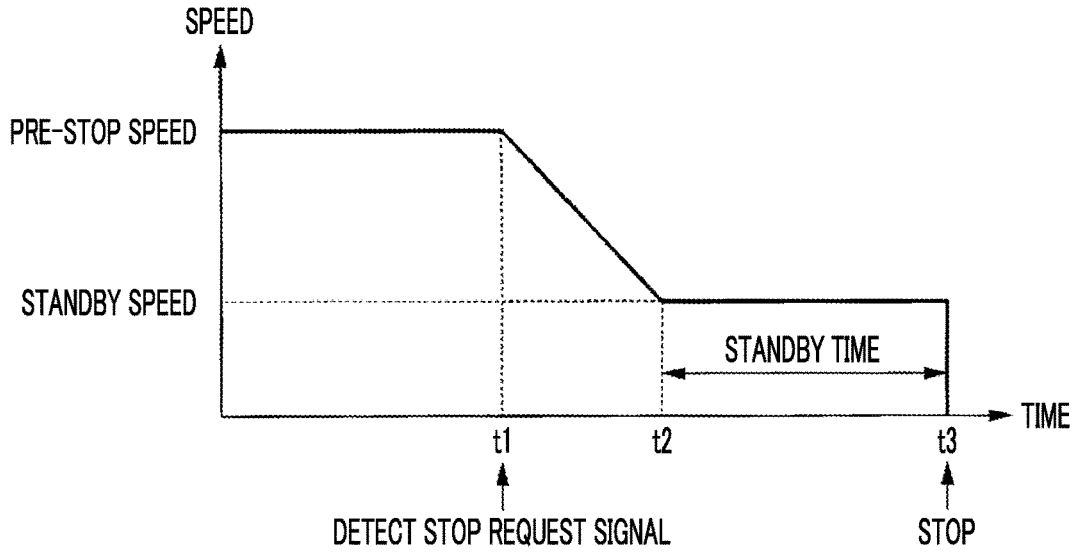
FIG. 4 is a diagram for describing a forced stop control of the electric compressor according to the embodiment of the invention.

Next, the forced stop control of the electric compressor 10 by the control device 50 will be described. FIG. 4 is a diagram for describing the forced stop control of the electric compressor according to the embodiment of the invention. FIG. 4(*a*) shows parameters used for the forced stop control, and FIG. 4(*b*) shows a transition of the speed of the electric compressor 10 during the forced stop control. First, the speed control unit 53 determines which speed region the pre-stop speed belongs to. Three speed regions are set in a setting example of FIG. 4(*a*). A "speed region 1" in the first row is set for a range where the speed is a "threshold value 1" or more. A "speed region 2" in the second row is set for a range where the speed is equal to or larger than a "threshold value 2" and less than the "threshold value 1". A "speed region 3" in the third row is set for a range where the speed is less than the "threshold value 2". The speed control unit 53 determines the speed region including the pre-stop speed among the plurality of speed regions determined for the speed in each range.

When the speed region is determined, the speed control unit 53 performs the forced stop control according to the process determined for each speed region. Specifically, the speed control unit 53 first stepwise decelerates the speed of the electric compressor 10 from the pre-stop speed according to the deceleration rate determined for each speed region. For example, in a case where the pre-stop speed is in the "speed region 1", the speed control unit 53 decelerates the speed of the electric compressor 10 at a deceleration rate "α". Similarly, the speed control unit 53 decelerates the speed of the electric compressor 10 at a deceleration rate "β" when the pre-stop speed is in the "speed region 2" and at a deceleration rate "γ" when the pre-stop speed is in the "speed region 3".

The speed control unit 53 continues the deceleration control based on the deceleration rate until the speed of the electric compressor 10 reaches a predetermined target value. A target speed when the deceleration control ends is also set for each speed region, and the value is described in a "standby speed" field in the table of FIG. 4(*a*). For example, in the case where the pre-stop speed is in the "speed region 1", the target speed is a value obtained by subtracting "A" (A is a predetermined constant) from the pre-stop speed. The speed control unit 53 ends the deceleration control when a speed after the deceleration control is reduced by "A" from the pre-stop speed. In the case where the pre-stop speed is in the "speed region 2", the speed control unit 53 ends the deceleration control when the speed after the deceleration control reaches "B" (B is a predetermined constant). In the case where the pre-stop speed is in the "speed region 3", the speed control unit 53 continues the deceleration control until the speed after deceleration control is "0" (stop).

Next, the standby time will be described. The standby time is a time for maintaining the target speed after the end of the deceleration control. The standby time is also set for each speed region. In the setting example of FIG. 4 (*a*), the standby time is "T1" in the case where the pre-stop speed is in the "speed region 1", and the standby time is "T2" in the case where the pre-stop speed is in the "speed region 2". The standby times "T1" and "T2" may be zero (non-standby). In the case where the pre-stop speed is in the "speed region 3", the speed control unit 53 sets the standby time to "0" for continuing the deceleration control until the speed becomes "0". When the speed of the electric compressor 10 reaches the standby speed, the speed control unit 53 starts to measure a time and maintains a standby rotation until the standby time elapses. Each parameter illustrated in FIG. 4(*a*) is recorded in the storage unit 54.

The forced stop control after the stop request detector 51 detects the forced stop request signal will be described with reference to FIG. 4(*b*). In FIG. 4(*b*), the vertical axis represents the speed of the electric compressor 10, and the horizontal axis represents the time. When the stop request detector 51 detects the forced stop request signal (power supply shutdown signal at the time of key-off) at timepoint t1, the speed control unit 53 starts the forced stop control. First, the speed control unit 53 decelerates the speed of the electric compressor 10 at a deceleration rate corresponding to the speed region to which the pre-stop speed belongs (timepoint t1 to t2). When the speed of the electric compressor 10 reaches a pre-stop speed corresponding to the speed region, the speed control unit maintains a current speed for a standby time corresponding to the speed region (timepoint t2 to t3). When the standby time elapses, the speed control unit 53 stops the electric compressor 10.

Figures 5, 6:
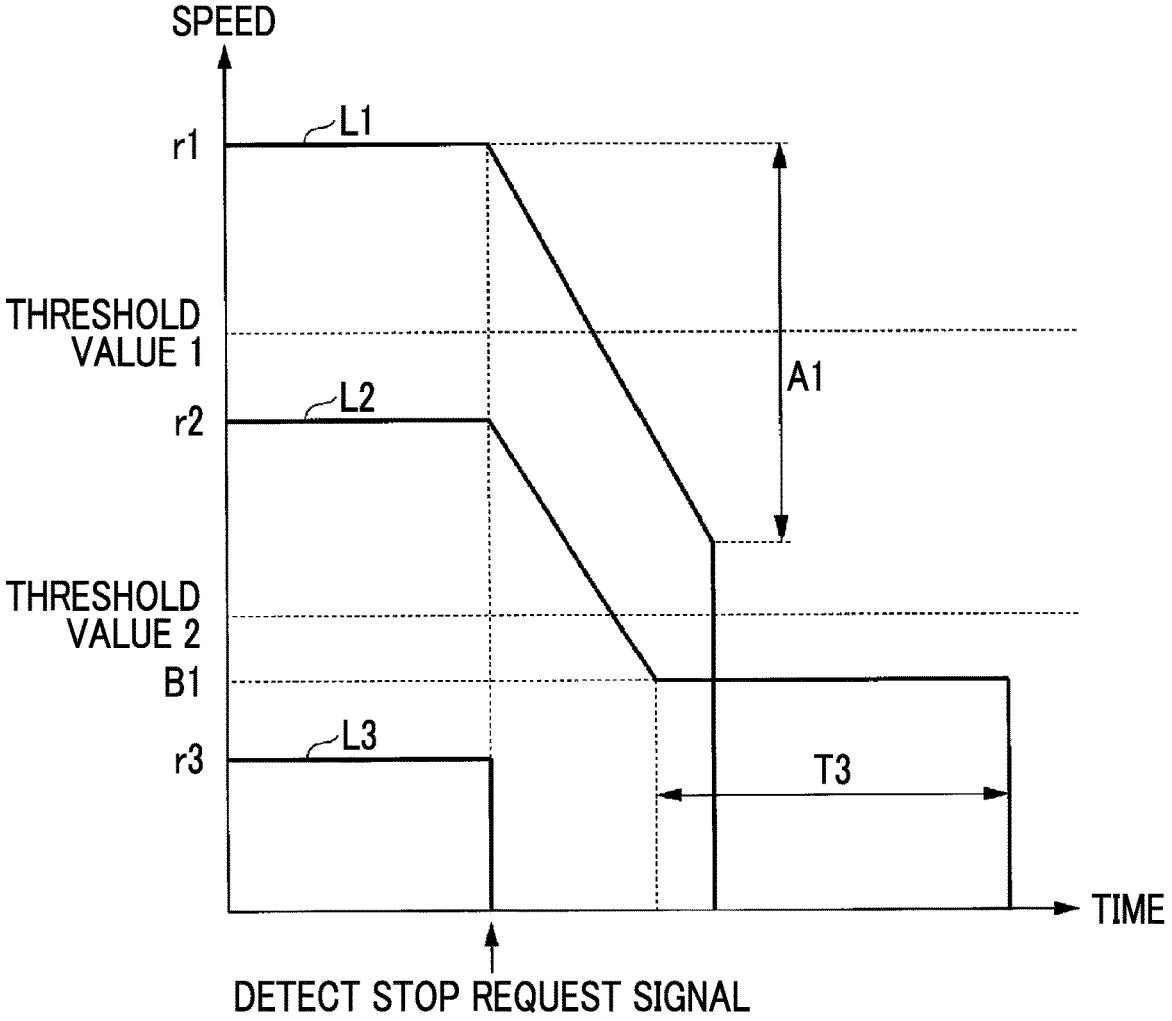
FIG. 5 is a table showing an example of parameters used for the forced stop control of the electric compressor according to the embodiment of the invention.
FIG. 6 is a diagram showing an example of transitions in a speed during the forced stop control of the electric compressor according to the embodiment of the invention.

Next, specific examples of the forced stop control are shown in FIGS. 5 and 6. FIG. 5 is a table showing an example of parameters used for the forced stop control of the electric compressor according to the embodiment of the invention. Three speed regions are set in a setting example of FIG. 5. Similar to the case of FIG. 4(*a*), the range of each speed region is set as follows: speed region 1 is speed≥threshold value 1, speed region 2 is threshold value 1>speed≥threshold value 2, and speed region 3 is threshold value 2>speed. The deceleration rate of the speed region 1 is "α1", the standby speed thereof is "stop speed—A1", and the standby time thereof is "0". The deceleration rate in the speed region 2 is "α1", the standby speed thereof is "B1", and the standby time thereof is "T3". The deceleration rate of the speed region 3 is "none", the standby speed thereof is "0", and the standby time thereof is "0".

FIG. 6 shows a transition of the speed in the forced stop control of the electric compressor 10 based on the setting of FIG. 5. FIG. 6 is a diagram showing an example of transitions in the speed during the forced stop control of the electric compressor according to the embodiment of the invention. A graph L1 shows the transition of the speed in a case where a pre-stop speed r1 is in the range of the "speed region 1". After the forced stop request signal is detected, the speed control unit 53 decelerates the pre-stop speed r1 at the rate of α1. When the speed reaches the standby speed "r1-A1", the speed control unit 53 stops the electric compressor 10 (the speed of the motor 12 is set to zero) based on the setting of the standby time "0". As described above, in a case where the pre-stop speed is larger than the predetermined threshold value 1, the speed can be significantly decelerated from the pre-stop speed by setting the parameter A1 included in the standby speed to be large. The applicants have confirmed through experiments that it is possible to suppress the occurrence of the abnormal current at the time of key-off due to the parameter setting for the "speed region 1" shown in FIG. 5. This is considered to be related to the significant reduction in the speed due to the setting of the parameter A1. In the example, the standby time is set to "0" as the parameter of the forced stop control for the "speed region 1". However, an appropriate value may be set for the standby time and a state of standby until the rotation stops may be provided.

A graph L2 shows the transition of the speed in a case where a pre-stop speed r2 is in the range of the "speed region 2". After the forced stop request signal is detected, the speed control unit 53 decelerates the pre-stop speed r2 at the rate of al. When the speed reaches the standby speed "B1", the speed control unit 53 maintains a state of the standby speed B1 by the time "T3" based on the setting of the standby time "T3". Thereafter, the speed control unit 53 stops the electric compressor 10. For example, a value equal to or less than the threshold value 2 can be set as the standby speed B1. As described above, the applicants have confirmed through experiments that it is possible to suppress the occurrence of the abnormal current at the time of key-off due to the parameter setting for the "speed region 2" shown in FIG. 5 by setting an appropriate value for the standby speed B1 in the case where the pre-stop speed is in between the threshold value 1 and the threshold value 2. This is considered to be related to the fact that the speed is reduced to a sufficiently small speed indicated by the standby speed B1. In the example, the standby time is set to T3 as the parameter of the forced stop control for the "speed region 2", but the standby time may be set to zero. Alternatively, any appropriate value including zero in T3 may be set as the standby time according to magnitude of the standby speed B1.

The graph L3 shows the transition of the speed in a case where a pre-stop speed r3 is in the range of the "speed region 3". The speed control unit 53 sets the pre-stop speed r3 to zero immediately after the forced stop request signal is detected based on the setting of the standby speed "0", the deceleration rate "none", and the standby time "0". The applicant has confirmed through experiments that it is possible to suppress the occurrence of the abnormal current at the time of key-off due to the parameter setting for the "speed region 3" shown in FIG. 5. In a case where the pre-stop speed is less than the threshold value 2, the speed is sufficiently small. Therefore, it is considered that no abnormal current occurs even when the rotation is stopped immediately. The parameters of the forced stop control for the "revolution speed region 3" are not limited to the example of FIG. 5. For example, an operation may be set in which the speed is reduced to a predetermined standby speed at a predetermined deceleration rate, and then the rotation is stopped after standby for a while similar to the case of the "revolution speed region 2".

Figure 7:
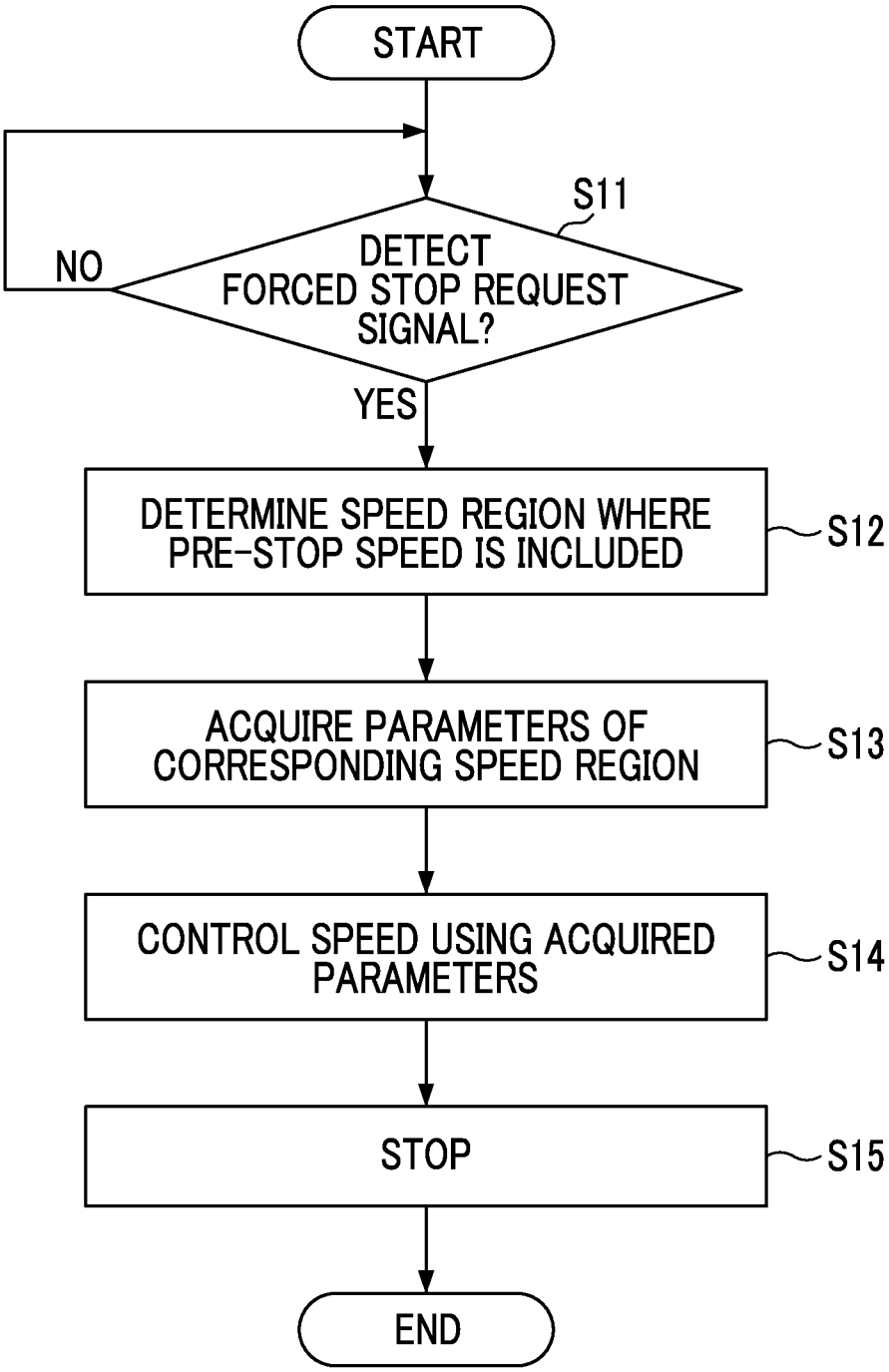
FIG. 7 is a flowchart showing an example of the forced stop control of the electric compressor according to the embodiment of the invention.

Next, a flow of the forced stop control of the electric compressor according to the embodiment will be described. FIG. 7 is a flowchart showing an example of the forced stop control of the electric compressor according to the embodiment of the invention. First, the stop request detector 51 detects the forced stop request signal from the vehicle 3 (step S11). For example, the signal lines or the like that connects the ECU 1 and the air conditioning device 2 of the vehicle 3 include a signal line that performs a notification of a control signal related to on and off of the electric compressor 10 (FIG. 1). When the signal line is turned off while the air conditioning device 2 is in operation, the stop request detector 51 determines that the forced stop request signal is detected. In a case where the forced stop request signal is not detected (step S11; No), it stands by until the signal is detected.

In a case where the forced stop request signal is detected (step S11; Yes), the speed acquisition unit 52 acquires the pre-stop speed of the electric compressor 10. It is possible to acquire the speed of the electric compressor 10 by a known method. For example, the speed may be detected by a sensor, calculated from various detection values (current value, voltage value, and the like in the three-phase power of the motor 12) detected by the sensor, or a command value acquired from the ECU 1. The speed acquisition unit 52 outputs the acquired speed of the electric compressor 10 to the speed control unit 53.

Next, the speed control unit 53 determines a speed region where the pre-stop speed acquired from the speed acquisition unit 52 is included (step S12). Specifically, the speed control unit 53 refers to the parameter setting information illustrated in FIG. 4(*a*) and FIG. 5 recorded in the storage unit 54 to determine the speed region. Next, the speed control unit 53 reads out and acquires parameters determined for the corresponding speed region from the storage unit 54 (step S13). Next, the speed control unit 53 controls the speed of the electric compressor 10 using the acquired parameters (step S14). A specific control method is as described with reference to FIGS. 4 to 6. That is, the speed control unit 53 decides a target speed (standby speed) and decelerates from a current pre-stop speed to the target speed at a predetermined deceleration rate. The speed control unit 53 maintains the target speed for a certain period (standby time) depending on the speed region and then stops the electric compressor 10 (step S15). Accordingly, the occurrence of the abnormal current due to a sudden non-supply of the power during the rotation of the motor 12 is suppressed, and the influence on the circuit 100 is reduced.

In general, the rotation of the electric compressor 10 is decided by a request from the vehicle 3 (ECU 1), and the speed is controlled so as to follow the request. In a case where the key-off is performed on the vehicle 3 side while the air conditioning device 2 is in operation (state where the electric compressor 10 is operated and the motor 12 is in rotation), the motor 12 is immediately stopped while the motor 12 is in rotation. With the control device 50 according to the embodiment, even in such a situation, it is possible to control the speed of the electric compressor 10 and suppress the occurrence of a large current (spike current) to the high voltage circuit.

All or some of the functions of the control device 50 may be realized by hardware composed of an integrated circuit such as a large scale integration (LSI). All or some of the functions of the control device 50 may be configured of a computer such as a micro computer unit (MCU). In the case, a CPU of the control device 50 may execute a program to realize a course of each process in the control device 50, for example.

In addition, the constituent elements in the above embodiments can be replaced as appropriate with known constituent elements within the scope not departing from the gist of the invention. The technical scope according to the invention is not limited to the embodiments described above, and various changes can be added within the scope not departing from the gist of the invention.

In the above examples, three speed regions are provided, but the speed region may be one to two, or four or more. The pre-stop speed may not be classified for each speed region. The speed control unit 53 may perform a control so as to decelerate the pre-stop speed at a deceleration rate corresponding to the pre-stop speed and then stand by for a standby time corresponding to the pre-stop speed. For example, the storage unit 54 records a function or a data table that define a correspondence between the speed and the deceleration rate, a function or a data table that define a correspondence between the speed and the standby speed, and a function or a data table that define a correspondence between the speed and the standby time. The speed control unit 53 calculates a subtraction rate from the function or the like that defines the correspondence between the speed and the deceleration rate and the pre-stop speed acquired by the speed acquisition unit 52, and calculates a standby speed using the function or the like that defines the correspondence between the speed and the standby speed. The speed control unit 53 decelerates the speed of the electric compressor 10 to the standby speed calculated at the calculated subtraction rate. The speed control unit 53 calculates a standby time from the function or the like that defines the correspondence between the speed and the standby time and the pre-stop speed acquired by the speed acquisition unit 52, and stands by for the standby time after the speed of the electric compressor 10 reaches the standby speed. Thereafter, the speed control unit 53 stops the electric compressor 10.

In the above embodiments, the case where the electric compressor 10 constitutes a part of the car air conditioner of the vehicle 3 is described as an example. However, the control device 50 and the electric compressor 10 according to the embodiment may be adapted to an air conditioning device for a refrigeration vehicle. The device to which the control device 50 and the electric compressor 10 according to the embodiment are adapted may be an air conditioning device mounted on various moving objects such as a ship, an aircraft, and a train other than the vehicle.

The forced stop request signal is not limited to the signal generated by the key-off operation. The forced stop request signal may be a power supply shutdown for some reason or a forced stop signal. The forced stop request signal is, for example, a signal generated from a device external to a device that directly controls the electric compressor 10 (the in-vehicle air conditioning device 2 in the embodiment) and a higher-level device (the vehicle 3 in the embodiment) including the device (the in-vehicle air conditioning device 2 in the embodiment) or linking with the device. That is, the forced stop request signal is a signal indicating the stop of the power supply received in a state in which the electric compressor 10 or the control device 50 cannot be controlled. For this reason, the forced stop request signal is a stop request signal having the property that the normal stop control cannot be performed. The speed control unit 53 is an example of an operation stop control unit.

INDUSTRIAL APPLICABILITY

With the control device for the electric compressor, the electric compressor, the air conditioning device for the moving object, and the method for controlling the electric compressor, it is possible to safely stop the electric compressor even in the case where the forced stop request different from the normal stop request signal is received.

REFERENCE SIGNS LIST

1: ECU
2: air conditioning device
10: electric compressor
11: compression unit
12: motor
20: battery
30: capacitor
40: inverter
50: control device
51: stop request detector
52: speed acquisition unit
53: speed control unit
54: storage unit

The invention claimed is:

1. A control device for an electric compressor comprising:

a stop request detector that detects a forced stop request signal indicating a forced stop of power supply with respect to an electric compressor that is received from a device external to the electric compressor regardless of an operation state of the electric compressor; and an operation stop control unit that stops the electric compressor in a process different from a normal stop process determined for the electric compressor when the stop request detector detects the forced stop request signal, wherein the operation stop control unit is capable of stopping the electric compressor while taking a stop time that differs by the different process according to a speed of the electric compressor when the forced stop request signal is detected.

2. The control device for an electric compressor according to claim 1, wherein the operation stop control unit determines a speed range where the speed when the forced stop request signal is detected is included among a plurality of speed ranges determined stepwise for the speed of the electric compressor and stops the electric compressor based on a process determined for each speed range.

3. The control device for an electric compressor according to claim 1, wherein the operation stop control unit decelerates the speed when the forced stop request signal is detected based on a deceleration rate determined for the speed when the forced stop request signal is detected.

4. The control device for an electric compressor according to claim 3, wherein the operation stop control unit decelerates the speed of the electric compressor by a predetermined speed based on the deceleration rate.

5. The control device for an electric compressor according to claim 3, wherein the operation stop control unit decelerates the speed of the electric compressor to a predetermined speed based on the deceleration rate.

6. The control device for an electric compressor according to claim 3, wherein the operation stop control unit decelerates the speed of the electric compressor based on the deceleration rate, then stands by for a predetermined time, and then stops the electric compressor.

7. The control device for an electric compressor according to claim 3, wherein in a case where the speed when the forced stop request signal is detected is equal to or larger than a first threshold value, the operation stop control unit decelerates the speed of the electric compressor by a predetermined speed at a deceleration rate determined for a speed range equal to or larger than the first threshold value and then stops a rotation of the electric compressor.

8. The control device for an electric compressor according to claim 7, wherein in a case where the speed when the forced stop request signal is detected is equal to or larger than a second threshold value and less than the first threshold value, the operation stop control unit decelerates the speed of the electric compressor to a predetermined speed at a deceleration rate determined for a speed range of from the second threshold value to the first threshold value, then stands by for a predetermined time, and then stops the rotation of the electric compressor.

9. The control device for an electric compressor according to claim 8, wherein in a case where the speed when the forced stop request signal is detected is less than the second threshold value, the operation stop control unit immediately stops the rotation of the electric compressor.

10. The control device for an electric compressor according to claim 2, wherein the operation stop control unit decelerates the speed when the forced stop request signal is detected based on a deceleration rate determined for the speed when the forced stop request signal is detected.

11. The control device for an electric compressor according to claim 4, wherein the operation stop control unit decelerates the speed of the electric compressor based on the deceleration rate, then stands by for a predetermined time, and then stops the electric compressor.

12. The control device for an electric compressor according to claim 5, wherein the operation stop control unit decelerates the speed of the electric compressor based on the deceleration rate, then stands by for a predetermined time, and then stops the electric compressor.

13. The control device for an electric compressor according to claim 4, wherein in a case where the speed when the forced stop request signal is detected is equal to or larger than a first threshold value, the operation stop control unit decelerates the speed of the electric compressor by a predetermined speed at a deceleration rate determined for a speed range equal to or larger than the first threshold value and then stops a rotation of the electric compressor.

14. An electric compressor comprising:

the control device for an electric compressor according to claim 1.

15. An air conditioning device for a moving object, the device comprising:

the electric compressor according to claim 14, wherein the forced stop request signal is a signal for stopping the moving object.

16. A method for controlling an electric compressor comprising:

a step of detecting a forced stop request signal indicating a forced stop of power supply with respect to an electric compressor that is received from a device external to the electric compressor regardless of an operation state of the electric compressor; and a step of stopping the electric compressor in a process different from a normal stop process determined for the electric compressor when the forced stop request signal is detected, wherein the electric compressor can be stopped while taking a stop time that differs by the different process according to a speed of the electric compressor when the forced stop request signal is detected in the step of stopping the electric compressor.

* * * * *